United States Patent [19]

Eglin

[11] Patent Number: 4,557,025

[45] Date of Patent: Dec. 10, 1985

[54] AUTOMATIC SEAMING MACHINE

[75] Inventor: Steven Eglin, Accrington, England

[73] Assignee: Scapa-Porritt Limited, Blackburn, England

[21] Appl. No.: 604,624

[22] PCT Filed: Aug. 19, 1983

[86] PCT No.: PCT/GB83/00206

§ 371 Date: Apr. 19, 1984

§ 102(e) Date: Apr. 19, 1984

[87] PCT Pub. No.: WO84/00782

PCT Pub. Date: Mar. 1, 1984

[30] Foreign Application Priority Data

Aug. 20, 1982 [GB] United Kingdom ..... 8224063

[51] Int. Cl.[4] ..... D21F 1/00

[52] U.S. Cl. ..... 28/141

[58] Field of Search ..... 28/141, 209; 139/1 R, 139/11, 383 A, 55.1

[56] References Cited

U.S. PATENT DOCUMENTS 3,885,596 5/1975 Alexeff ..... 28/141

4,311,172 1/1982 Eckstein ..... 139/383 A

FOREIGN PATENT DOCUMENTS 0043441 1/1982 European Pat. Off. .

*Primary Examiner*—Henry S. Jaudon

*Attorney, Agent, or Firm*—Fleit, Jacobson, Cohn & Price

[57] ABSTRACT

A method of and a means for the automatic seaming of fabric ends to form an endless papermakers and like fabric which teaches the enlargement of the shed of a sheet of yarns, controlled by a jacquard mechanism (93) by shed fingers (98, 113) engageable with such shed (20) transversely of the weft yarns forming the same, to facilitate the successive introduction of individual free warp ends (28) extending from the respective ends to be joined by inserter members (123) which engage the shed from opposite sides thereof.

16 Claims, 11 Drawing Figures

AUTOMATIC SEAMING MACHINE

TECHNICAL FIELD OF THE INVENTION

The invention concerns an automatic seaming machine, and has more particular reference to a machine for use in joining together the ends of a papermakers or like fabric to produce an endless structure.

BACKGROUND ART

Heretofore, papermakers fabrics have been made endless by the process of hand weaving, with machine assistance, the individual ones of the warp yarns of the flat woven fabric with a set of weft yarns interposed between the ends to be joined, such a process being both laborious and time consuming. Those yarns interposed between the fabric ends to be joined will be referred to hereinafter as "weft yarns", since such yarns, as they exist in the finished seam, lie parallel to the weft, that is to say cross-machine direction, yarns of the fabric at large.

The object of the present invention is to provide a means whereby the joining (or seaming) might be effected mechanically or automatically.

DISCLOSURE OF THE INVENTION

According to one aspect of the present invention there is proposed apparatus for use in the mechanical seaming of opposed fabric ends comprising a shedding mechanism to receive and support a weft structure extending in the longitudinal direction of the intended seam, and to effect shedding thereof in accordance with requirements, and guide means locating a respective fringe of side-by-side warp yarns at each respective fabric end in requisite adjacent disposition relative to each other, and to the said weft structure, characterised by shed finger means selectively engageable with a weft structure carried by the shedding mechanism and adapted upon actuation, to enlarge the shed adjacent the fell of the woven seam for the time being existing, yarn engagement means selectively engageable with successive individual ones of the side-by-side warp yarns, at respective opposite sides of the machine, and yarn insertion means having a path of movement to engage a warp yarn engaged by the yarn engagement means and adapted, upon actuation, to insert such yarn into the shed.

According to another aspect of the invention there is proposed a method for the mechanical seaming of opposed adjacent fabric ends which includes the steps of providing opposed fringes of free warp yarns extending from each respective fabric end, introducing a weft structure between the said fabric ends to extend in alignment with the line of the intended seam, effecting successive shedding of the weft structure with the alternate introduction of one or more adjacent ones of the warp yarns of the said fringes into the shed from respective opposite sides thereof between each shed change, characterised by the step of physically enlarging the shed adjacent the fell of the fabric formed by the weft yarns and the last inserted free warp yarn prior to the insertion of the next free warp yarn or yarns thereinto.

BRIEF DESCRIPTION OF THE DRAWINGS

The invention will now be described further by way of example only with reference to the accompanying drawings which illustrate two embodiments thereof and in which.

BEST MODES OF CARRYING OUT THE INVENTION

Figure 1:
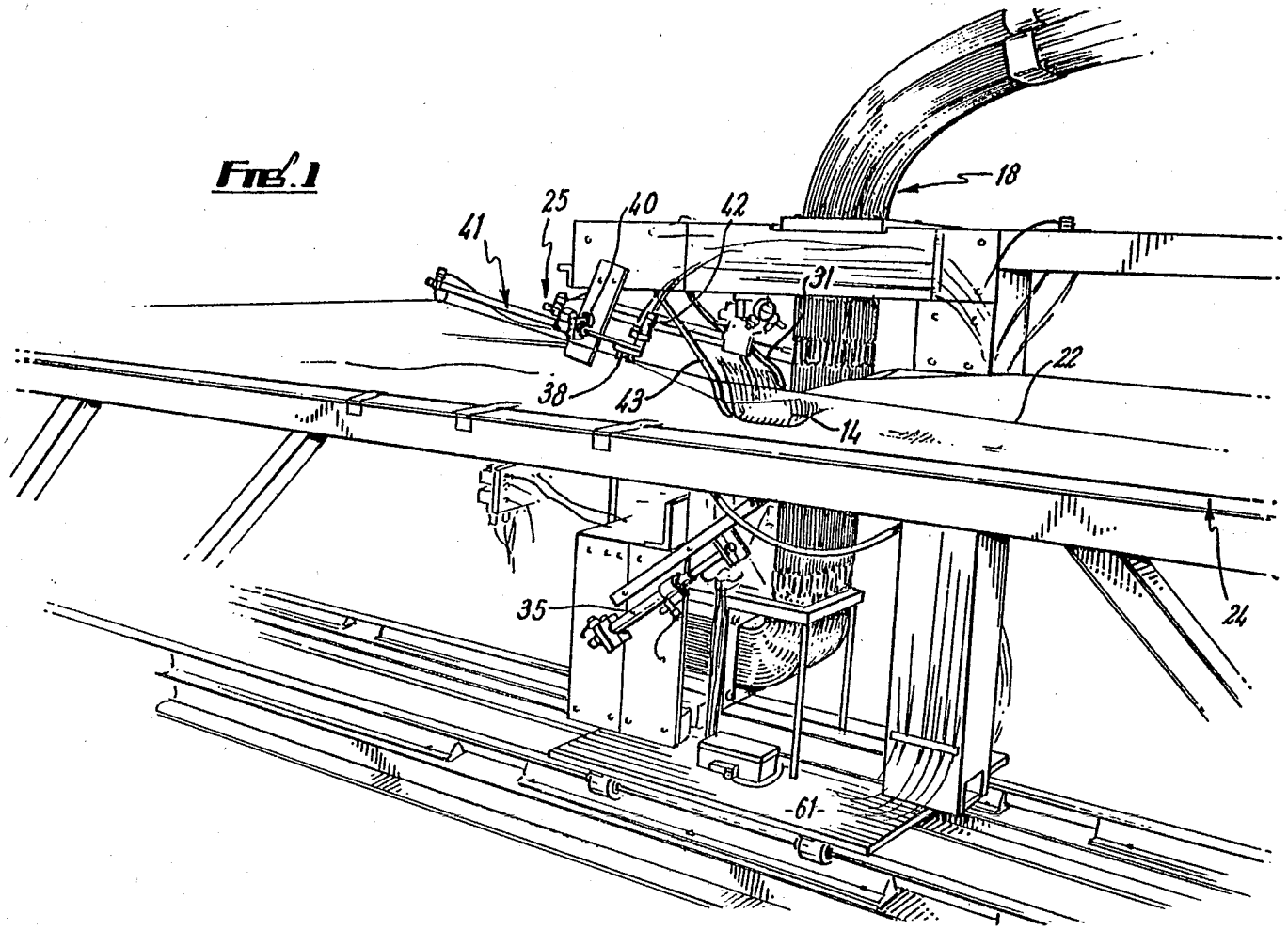
FIG. 1 is a perspective view of a first form of seaming machine constructed in accordance with the invention.

Referring now to the drawings, in joining opposed fabric ends 11, 12 by successively weaving the individual ones of two sets 13, 14 of side-by-side free warp yarns respectively extending from the fabric edges 15, 16 with a seaming weft 17 formed from pre-crimped yarns lying between and parallel to such edges 15, 16, the weft being supported by a shedding mechanism 18 operating in accordance with a predetermined pattern, shed finger means 19 are provided for engagement with the yarns of the weft 17 for opening the shed 20 beyond the position resulting from actuation of the shedding mechanism 18 so as to provide ready access to the space 21 immediately adjacent the fell of the woven seam for the time being existing, to facilitate introduction thereinto of the relevant free warp yarn.

The two sets of free warp yarns are each supported by a respective lease 22 extending parallel to and above the related edge 15, 16, the individual said warp yarns being folded back from the said edge and, in part, bearing on the underside of a foil member 23 secured to the machine structure 24. Respective selector means 25 are provided for each set of such warp yarns, the said means being adapted individually and successively to engage the individual ones of the yarns of the related set and to being the same into position for introduction into the shed 24 by a respective inserter means 26 provided at each side of the weft yarns.

Each of the inserter means 26 is mounted for reciprocating motion through the enlarged shed 21, and comprises a needle having crook-end 27 thereto which passes into and from the shed to engage the warp yarn 28 on its return motion and draw the same into the enlarged shed 21, and across a pneumatically operated yarn clamp 29 provided at that side of the shed towards which the warp yarn is drawn, the clamp 29 serving to tension the yarn 28 on its introduction into the enlarged shed 21 and being pivotally mounted for motion towards or away from the adjacent edge of the weft 17 to accommodate lateral displacement of an inserted warp yarn on beat-up thereof by a reed 30.

A selectively operable yarn cutter (not shown) is provided inwardly of each clamp 29 and serves to sever that part of the free warp yarn 28 which extends beyond the region of weaving thereof with the weft yarns at an appropriate stage in the beat-up and shed-change operation.

Figure 2:
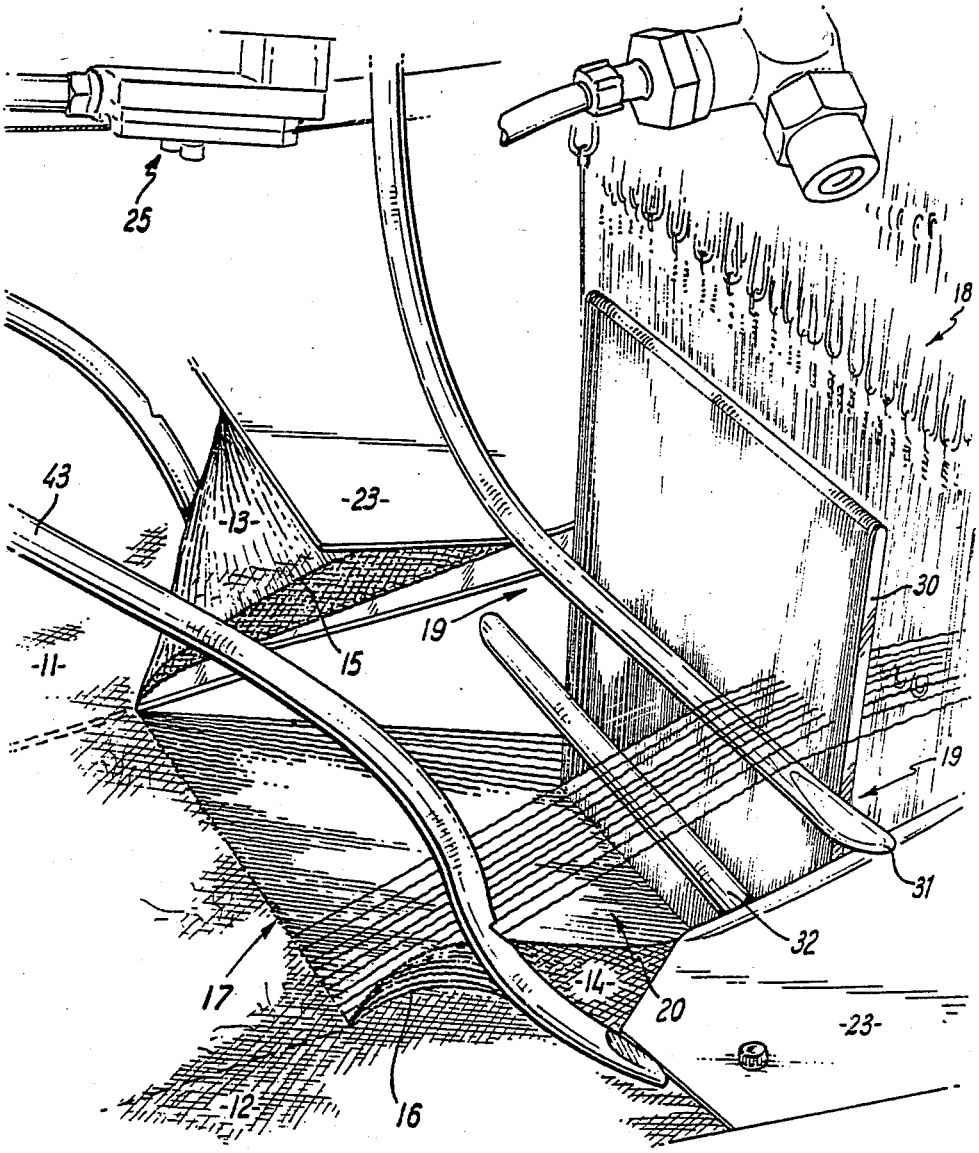
FIG. 2 is a perspective view of a part of the seaming machine of FIG. 1 shown to a larger scale, and illustrates the weft yarns displaced to provide a shed at one edge thereof, with the shed finger means engaged therewith at an initial position.
Figure 3:
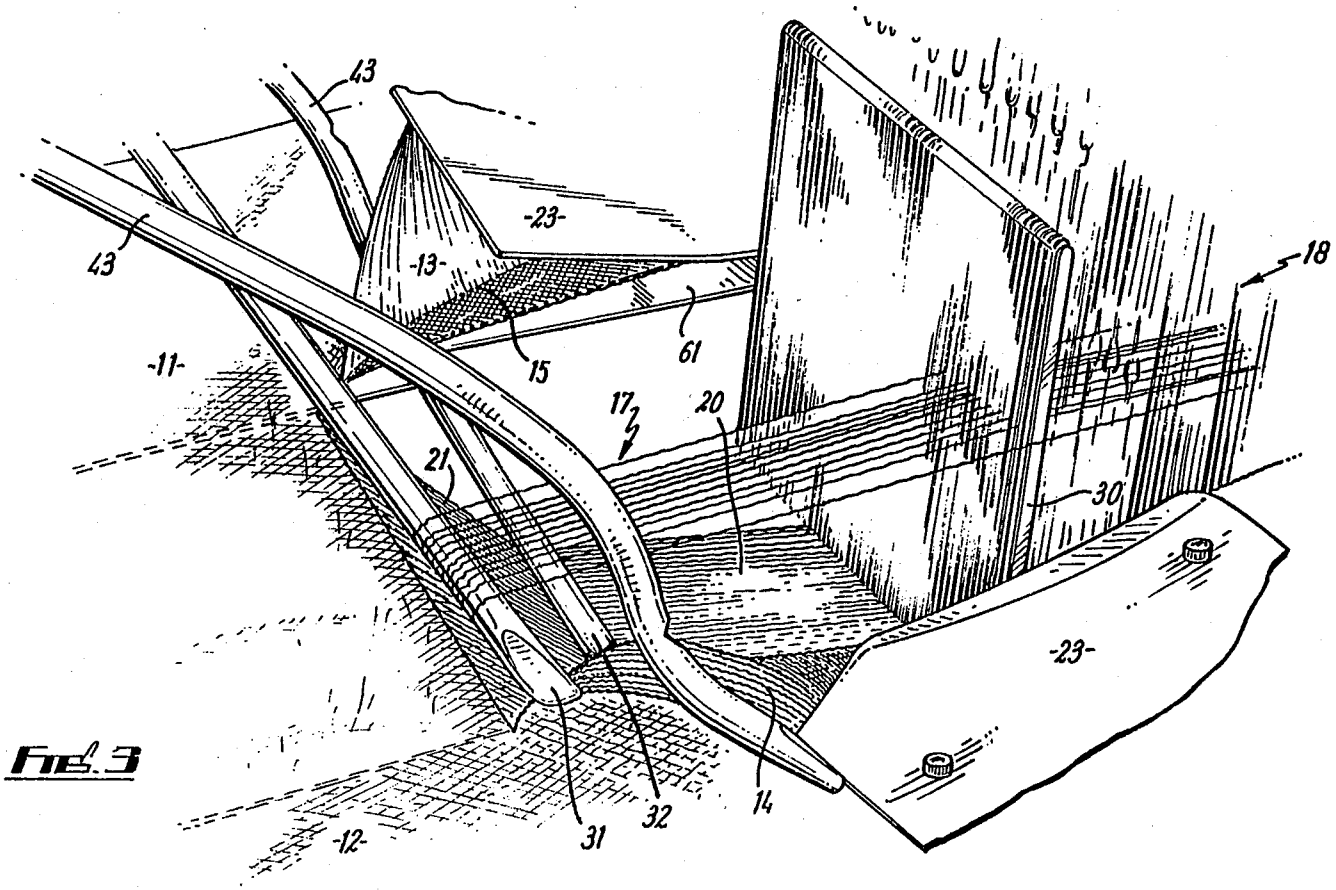
FIG. 3 is a view corresponding to FIG. 2, but differing therefrom in that the shed finger means have been moved towards the fell of the cloth to enlarge the shed.
Figure 4:
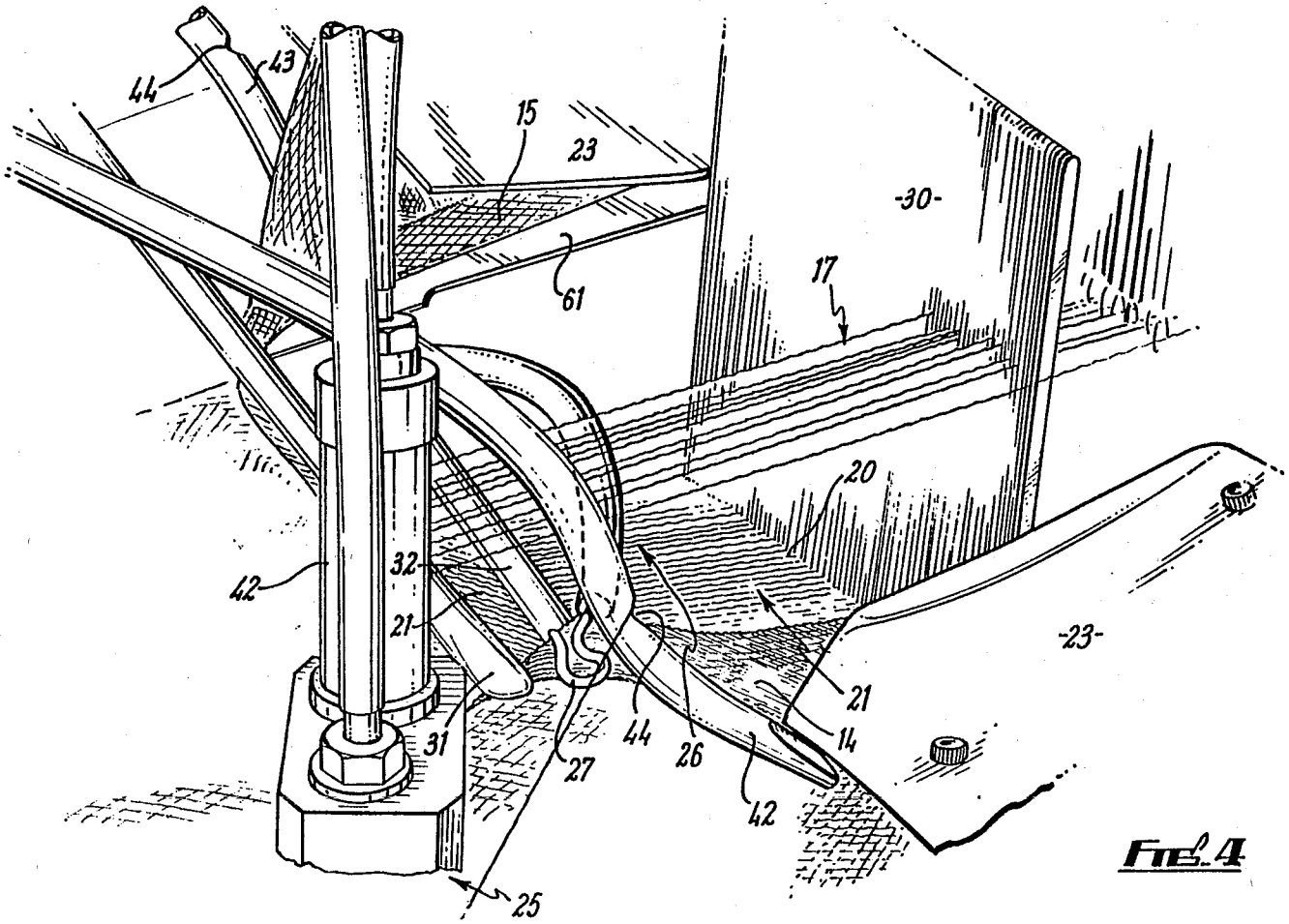
FIG. 4 is a further view corresponding to FIG. 2 and illustrates a later stage in the seaming operation wherein a free warp yarn has been selected and drawn to a position for engagement by the yarn inserter.

The shed finger means 19 comprise upper and lower fingers 31, 32 respectively provided at opposite sides of the weft and selectively engageable with the shed 20 in the lateral direction of the weft at a first position longitudinally of such weft, such finger means being movable from such first position towards the fell of the woven seam for the time being existing to respective second positions, the fingers 31, 32 engaging the upper and lower weft sheets respectively during the course of such movement and causing the shed to open up. First respective pneumatic piston and cylinder means 33 are provided for the upper and lower fingers to effect engagement thereof with the shed, that means controlling the lower finger only being shown, whilst second respective such means 34, 35 are provided for moving the fingers 31, 32 between the first and second positions thereof. FIG. 2 illustrates initial engagement of fingers with the shed, whilst FIG. 3 shows the position assumed by the fingers on movement from their first position to increase the size of the shed. It is to be observed that, whilst the upper finger 31 moves beyond the line of the last entered free warp yarn, the lower finger 32 moves through a lesser distance.

Each lease 22 comprises two yarn structures 36, 37 arranged in closely spaced apart disposition, and so cooperating with the free warp yarns 28 as firmly to hold the same in adjacent side-by-side relationship, the leases 22 being of a length to extend beyond the ends of the edges to be seamed and passing freely through a respective one of the selector means 25 in a manner hereafter to be disclosed.

Each selector means 25, there being one at each side of the apparatus, comprises a support block 38 and a selectively actuable pin 39 mounted on the block and so cooperable therewith as, upon actuation, to trap a free warp yarn 23 positioned therebetween, the support block 38 being carried by the piston 40 of a pneumatic piston and cylinder arrangement 41 and being slidable longitudinally of the lease 22 between a first position, whereat the pin 39 is in register with the extreme free warp yarn 28 supported by the lease 22, and a second position, whereat the engaged yarn 28 lies in the path of movement of the relevant inserter means 26.

A pneumatic piston and cylinder arrangement 42 is provided for actuation of the pin 39 to and from its clamping position relative to the block 38. The pin 39 is so located in relation to the block 38 as, upon actuation, to engage the extreme free warp yarn 28 at a position between the spaced yarn structures 36, 37 of the lease, thereby to allow free translational movement of the yarn 28 (FIG. 5) longitudinally of the lease 22 on shift of the block 38 from its first to its second position.

A downwardly inclined guide bar 43 is mounted at each side of the weft, the selected free warp yarn 28 being drawn across such guide bar on movement of the block 38 of the selector means 25 to the second position thereof, the bar 43 including a notch 44 or other location means for engagement by the warp yarn 28, the said yarn 28, on being so engaged, lying in the path of movement of the relevant inserter means 26.

The needles which constitute the inserter means 26 are each of arcuate form and are mounted for pivotal movement about a common upwardly inclined axis, the needles entering the shed from respective opposite sides thereof and being operated by pneumatic means 45.

The operation of the seaming machine is as follows:

The shedding mechanism 18 is operated by a jacquard patterning arrangement (not shown) to divide the weft 17, the arrangement being such that a shed 20 is formed from yarns at one side only of the weft, and the shed finger means 19 is actuated to cause the individual fingers 31, 32 to enter the shed at a position remote from the fell.

The fingers 31, 32 are then moved towards the fell, and into engagement with the inclined weft yarns, by the respective pneumatic piston and cylinder means 34, 35 and, on continued such movement, open up such shed 20 to increase the vertical dimension thereof. As has previously been indicated, the upper finger 31, which finger 31 lies above the plane of the seam, moves beyond the line of the last inserted free warp yarn thus to maximise the increase in shed dimension in this critical area. The selector means 25 at that side of the weft whereat the shed is formed is actuated and the block 38 moves longitudinally of the lease 22 to a position in which the pin 39 lies in register with the extreme free warp yarn 28 supported by such lease, whereupon the pneumatic piston and cylinder arrangement 42 which controls the pin 39 is operated to cause such pin 39 to move and to clamp the yarn 28 relative to the block. On retraction of the piston 40 which carries the block 38, the free warp yarn 28 engaged by the pin 39 is separated from the appropriate one of the sets 13, 14 of side-by-side free warp yarns carried by the leases 22 and is moved into position for engagement by the relevant inserter needle 26, being properly located by engagement with the notch 44 provided in depending guide bar 43. The arcuate inserter needle 26 positioned to operate from the opposite side of the weft is actuated to engage the enlarged shed 21, the crook-end 27 of the needle passing beyond the free warp yarn 28 such that, on retraction of the needle, the crook-end 27 thereof will engage the yarn 28 and draw the same through the enlarged shed 21 and across the relevant one of the yarn clamps 29. The free warp yarn 28 as it now lies in the shed, is tensioned, is beaten up by operation of the reed, the inserter means 26 and the shed finger means 19 having been retracted, the shed is changed and any excess of yarn is severed by the cutter means. On shed change, a new shed is created at the other side of the weft from the remaining weft yarns, and a free yarn is drawn in from that side and woven with the weft yarns by a corresponding sequence of analogous operations using the relevant elements of the seaming apparatus. It is to be borne in mind that the proportion of the width of the weft which is shedded at each shedding operation is such that the seaming extends throughout the full width of the weft sheet, although the division may vary between successive pairs of free warp yarn insertions, a pair of such insertions comprising an insertion from each respective side or edge of the weft.

It is also to be borne in mind that the seaming instrumentalities are indexed progressively longitudinally of the weft as seaming progresses, and such instrumentalities are mounted accordingly.

It will be appreciated that, in the embodiment shown in FIGS. 1 to 6, the seaming instrumentalities are, in the main, disposed below the level of the fabric ends thus providing for the ready examination of the seam as seaming progresses and making possible an early detection of any malfunction of the apparatus. A further benefit from this arrangement lies in the ease with which the fabric ends might be positioned and the apparatus set up for seaming.

Figure 5:
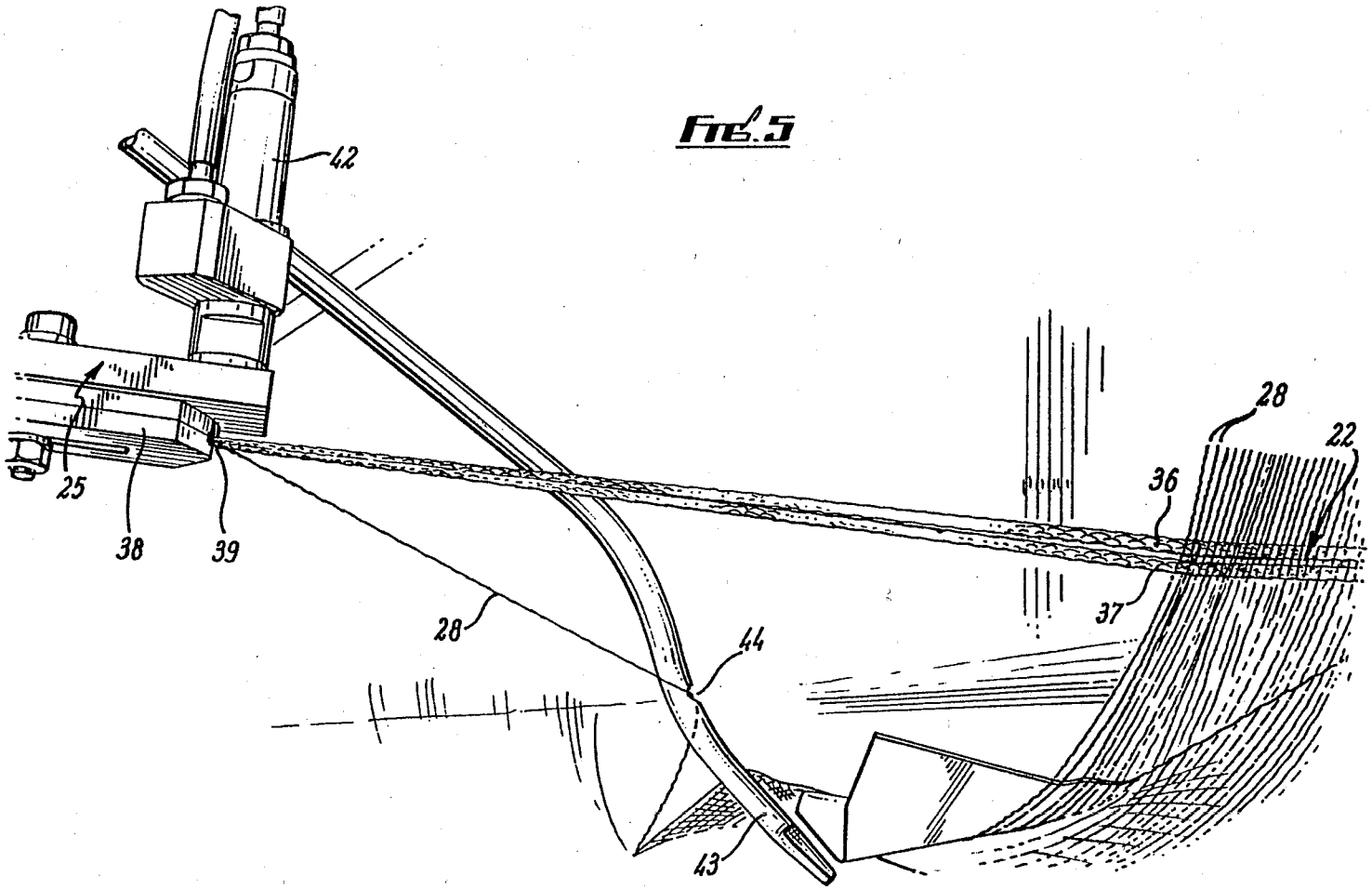
FIG. 5 is a side elevation corresponding to the stage in the seaming operation illustrated by FIG. 4 and shows the selector with a free warp yarn engaged therewith.
Figure 6:
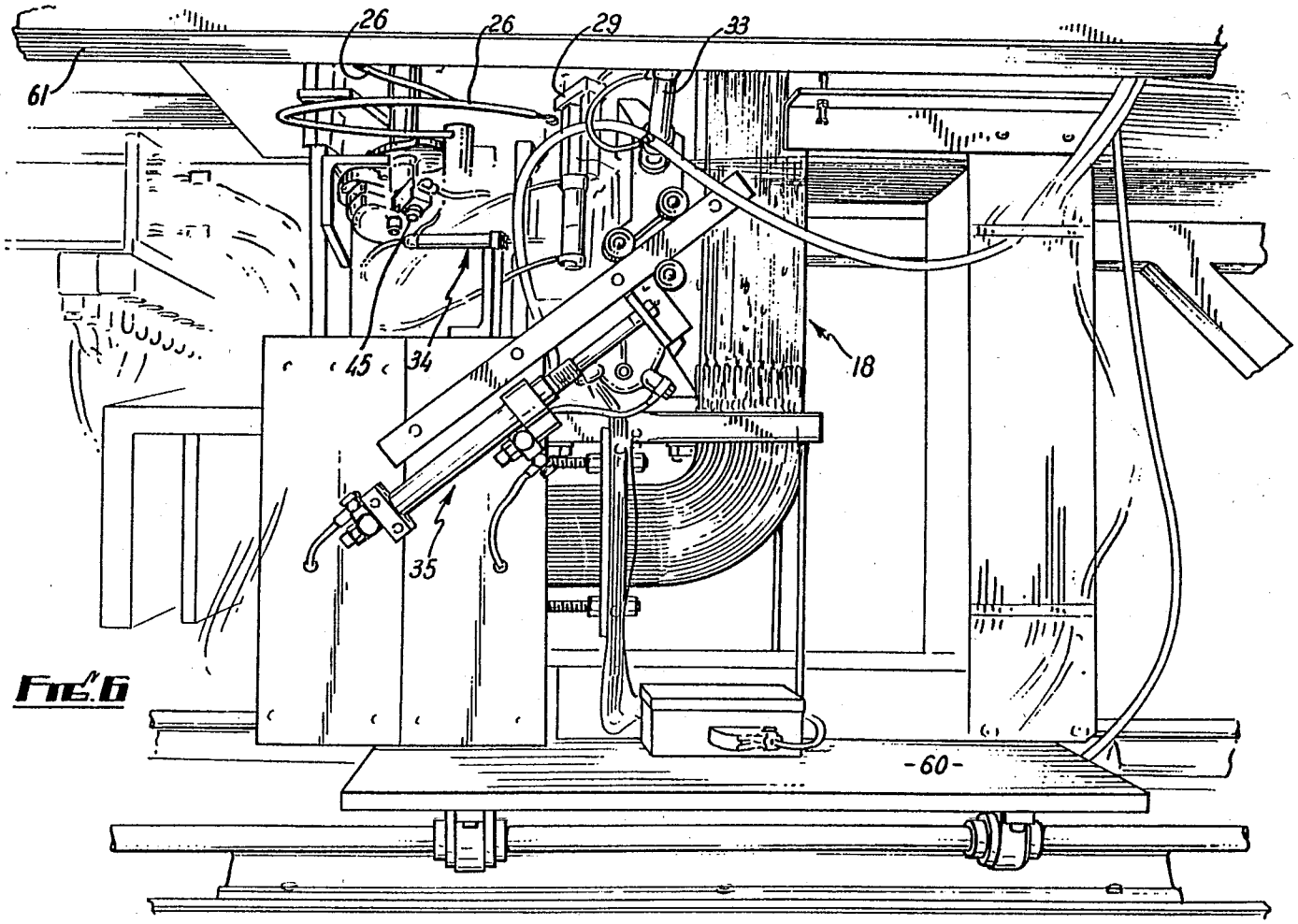
FIG. 6 is a side elevation of a part of the machine shown in FIG. 1, to a larger scale.
Figure 7:
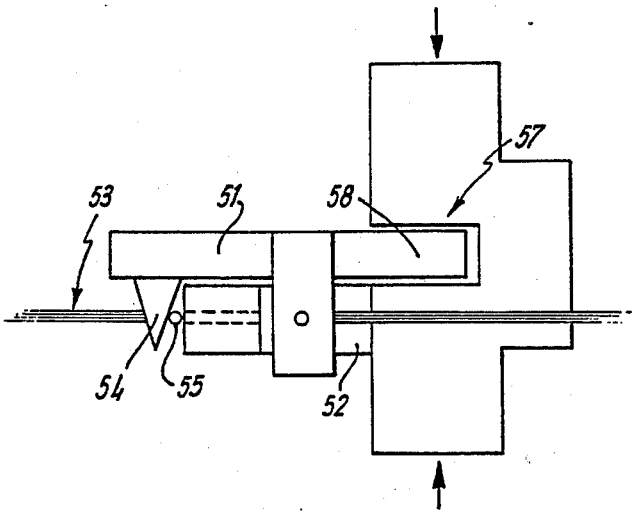
FIG. 7 is a diagrammatic side elevation of an alternative warp yarn selector head.
Figure 8:
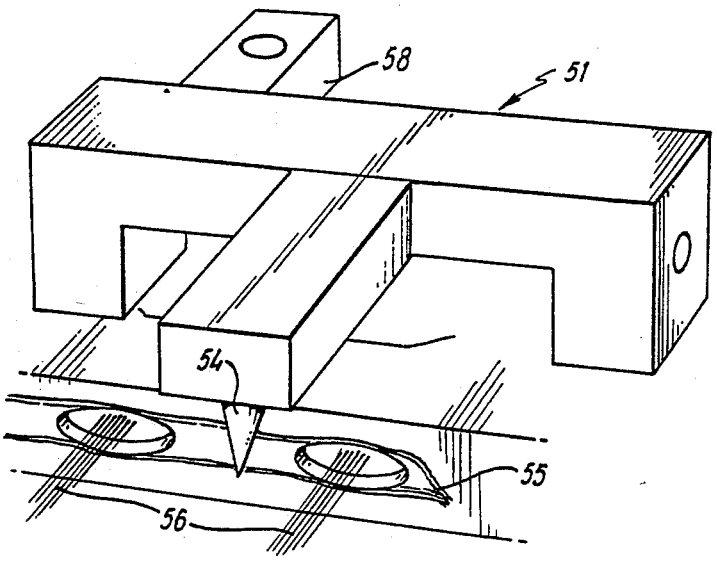
FIG. 8 is a diagrammatic perspective view of the yoke of the alternative head of FIG. 7.

As a modification of the selector means embodied in the machine shown in FIGS. 1 to 6 of the drawings, which means includes a block having a free warp yarn engaging pin slidably mounted therein for operation under the control of a pneumatic means to engage and clamp the free warp yarn relative to the block, there is proposed, particularly in the context of the seaming of a fine fabric, an alternative arrangement (see now FIGS. 7 and 8) wherein the block and pins of FIG. 5 are replaced by a yoke 51 pivotally mounted on a body 52 through which the lease 53 passes, the yoke 51 carrying a depending pin 54 engageable with the selected free warp yarn 55 at a position between the parallel yarn structure 56 of the lease and being pivoted into and out of its yarn engaging position under the control of a pneumatic piston and cylinder arrangement 57, operating on a lug 58 at that side of the axis of the yoke 51 remote from the pin 54.

Conveniently, the seaming instrumentalities of the embodiment hereinbefore described can be provided on a carriage 60 movably mounted relative to a fixed support as defined by spaced parallel support plates 61, one only being identifiable in the drawing, the fabric ends to be joined being positioned on a respective one of such support plates, with the seaming instrumentalities extending downwardly therebetween. The weft is disposed longitudinally of the space between the support plates, and generally in the plane thereof.

Figure 9:
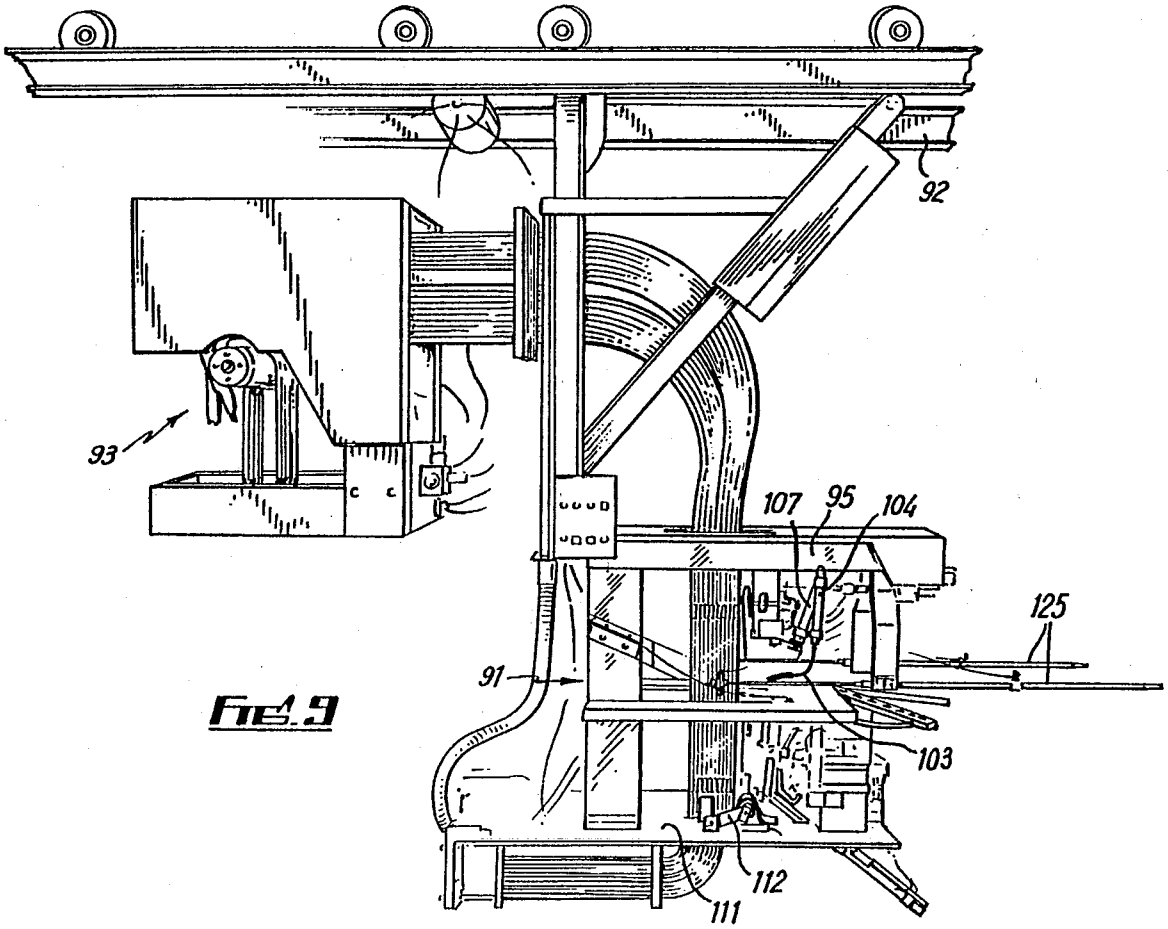
FIG. 9 is a generally diagrammatic side elevation of a modified form of the machine as shown in FIGS. 1 to 6.
Figure 10:
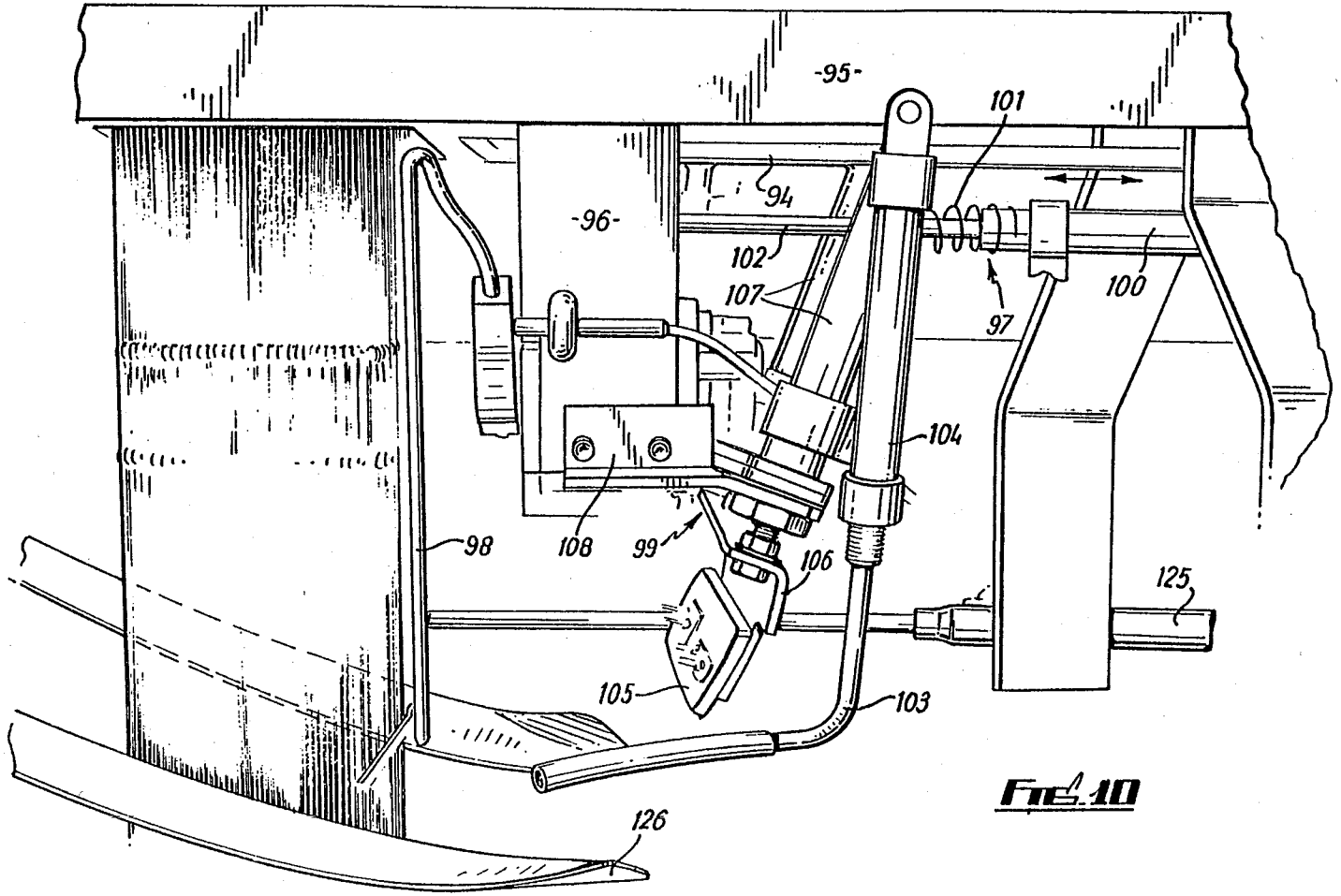
FIGS. 10 and 11 are enlarged views of parts of the arrangement shown in FIG. 9, parts having been omitted in the interests of clarity.
Figure 11:
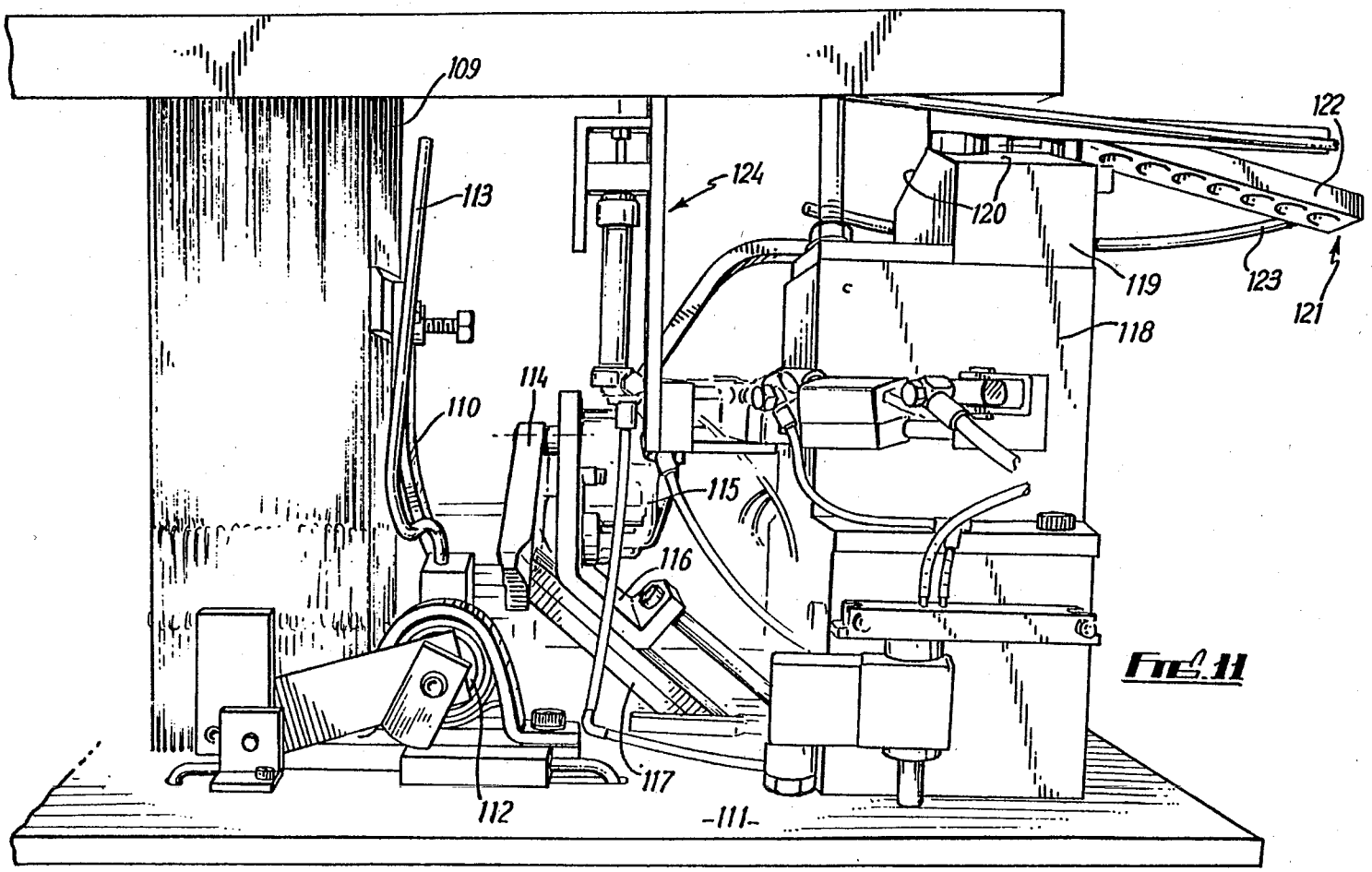

A modified seaming machine operating in an analogous manner to the seaming machine hereinbefore described but differing structurally therefrom in a number of regards is illustrated in FIGS. 9 to 11, such machine including a wiper blade arrangement in lieu of the cutting means, and the depending guide bars being pneumatically mounted.

Thus, referring now to FIGS. 9 to 11 of the drawings, and particularly to FIG. 9, a machine frame 91 of generally E-shaped configuration and carrying the seam forming instrumentalities is supported from overhead guide means 92 for progressive movement longitudinally thereof by suitable traction means, not shown, there being a jacquard mechanism 93 for controlling shed formation secured in tandem with the machine frame 91 and likewise supported in depending manner from the guide means 92 for movement with the machine frame. Control of the various seam forming instrumentalities is effected by a micro-processor provided adjacent the jacquard mechanism, and operating in conjunction therewith.

With particular reference to FIG. 10 of the drawings, a guide rail 94 is secured to the upper horizontal limb 95 of the frame 91 and supports a depending carriage 96 for movement longitudinally thereof under the control of a pneumatic piston and cylinder means 97, an upper shed finger 98, corresponding to finger 31 of the previous embodiment, being mounted on the carriage 96 for oscillation about an axis parallel to the guide rail 94 to and from a position of engagement with the weft shed. The carriage also supports a wiper mechanism 99 provided for a purpose and operating in a manner hereafter to be described.

The pneumatic piston and cylinder means 97 effects reciprocatory motion of the carriage 96 longitudinally of the guide rail 94 and comprises a pneumatic piston and cylinder arrangement 100 operating between such carriage and a fixed point on the frame 91, there being an abutment spring 101 arranged coaxially with the piston rod 102 of the arrangement 100 to facilitate initiation of the return motion of the carriage 96.

Limb 95 also supports, in depending fashion, and at each side thereof, a respective guide bar 103, such guide bars being secured to the piston rods of respective pneumatic piston and cylinder arrangements 104 and corresponding to the guide bars 43 of the embodiment shown in FIGS. 1 to 6 of the drawings.

Wiper mechanism 99 comprises a wiper blade 105, conveniently of leather, secured to bracket 106 carried by spaced, generally vertically disposed piston and cylinder arrangements 107, the piston and cylinder arrangements 107 being mounted on the carriage 96 by respective brackets 108 provided one at each side thereof. The wiper blade 105 is adjustable towards and away from the region of the seam being formed in synchoronism with the seam forming operation by the piston and cylinder arrangements and is reciprocated in the longitudinal direction of the seam on reciprocation of the carriage 96.

As with the embodiment shown in FIGS. 1 to 6 of the drawings, so too in the case of modified structure are the majority of the seam forming instrumentalities located below the level of the fabric ends. Thus, referring now particularly to FIG. 11, a reed 109 is mounted on a pivotted bracket 110 carried by the lower limb 111 of the frame and is moved to and from a beat-up position by drive means 112, whilst the lower shed finger 113 is carried by a support arm 114, and is oscillated in a plane transverse to the weft yarns to and from a position of shed engagement by pneumatic motor means 115 acting on such support arm. Motor means 115, together with support arm 114 and the lower shed finger 113 carried thereby, is mounted on a carriage 116 supported on an inclined guide 117, movement of such carriage, at an appropriate stage in the seaming cycle and in an appropriate sense, serving to cause the shed finger 113 to move longitudinally of the seam towards the fell of the shed and downwardly relative to the plane of the seam to contribute to the opening of the shed.

At the forward end of the lower limb 111 of the frame there is provided an upstanding bridge member 118, such bridge member 118 probiding, inter alia, a mounting block 119 having downwardly and outwardly inclined upper surface 120, each to receive a respective one of the yarn inserter means 121, the said inserter means 121 each being oscillatable about respective upwardly directed axes perpendicular to a respective surface 120. Each inserter means comprises a radial sweep arm 122 mounted, at one end, for limited motion about its respective axis of oscillation and a crook-ended arcuate needle 123 extending generally horizontally, from its other end. The bridge member 118 further supports, at each respective side thereof, a pivotally mounted yarn clamp 124, the said clamp being pneumatically actuated, and being of analogous form and operation to the yarn clamp of the embodiment shown in FIGS. 1 to 6 of the drawings.

The machine shown in FIGS. 9 to 11 further includes selector means 125 (FIGS. 9 and 11) whereby the individual free warp yarns can be removed from the leases by which they are supported and foil members 126 about which the free warp yarns are folded back at each of the ends to be joined, in like manner to the embodiment previously described.

The operation of the seaming machine shown in FIGS. 9 to 11 is directly analogous to that of the machine shown in FIGS. 1 to 6, as regards shed selection and enlargement, yarn selection and insertion, and beat up, and further description thereof is thought unnecessary, save in relation to the wiper blade 105. Thus, whereas in the case of the embodiment of FIGS. 1 to 6 the ends of the free warp ends are automatically severed after beat up, in the machine of FIGS. 9 to 11 such ends are removed in a subsequent operation but are moved away from the vicinity of free warp insertion by operation of the wiper mechanism 99, the blade 105 of such mechanism being moved into contact with the weft by operation of the piston and cylinder arrangement 107 and wiped across the top of such weft and that part of the formed seam adjacent the last inserted free warp end on forward movement of the carriage 96, the blade 105 moving those free warp ends extending from the formed seam out of the path of movement of any adjacent seam forming instrumentalities and thereby avoiding inadvertent introduction of such free warp ends into the seam.

Whilst it is found desirable to enlarge the shed by displacement both of the upper and lower sheets of weft yarns, displacement of one only of such sheets may be found sufficient in some instances, the yarn inserters being appropriately positioned to utilise to the full the increased height of the shed resulting from displacement of the weft yarn sheet in question.

It has been found convenient to provide an inserter operating from each respective side of the seam, the inserters being actuated in succession to weave free warp yarn with some only of the weft yarns, a seaming cycle comprising an insertion from each side. However, it may be preferred, in some instances, to provide insertion means at one side only of the weft, and to arrange that the insertion means introduce a free warp yarn into the shed in both directions of movement across the shed.

I claim:

1. Apparatus for use in the mechanical seaming of opposed fabric ends comprising a shedding mechanism to receive and support a weft structure extending in the longitudinal direction of the intended seam and to effect shedding thereof in accordance with requirements, and guide means locating a respective fringe of side-by-side warp yarns at each respective fabric end in requisite adjacent disposition relative to each other and to the said weft structure, characterised by shed finger means (19, 98, 113) selectively engageable with a weft structure (17) carried by the shedding mechanism and adapted upon actuation, to enlarge the shed (20) adjacent the fell (21) of the woven seam for the time being existing, yarn engagement means (25, 125) selectively engageable with successive individual ones of the side-by-side warp yarns (28), at respective opposite sides of the machine, and yarn insertion means (26, 121) having a path of movement to engage a warp yarn (28) engaged by the yarn engagement means (25, 125) and adapted, upon actuation, to insert such yarn into the shed (20).

2. Apparatus as claimed in claim 1, wherein the shed finger means (19, 98, 113) is mounted for translational motion longitudinally of the line of intended seam.

3. Apparatus as claimed in claim 1, wherein the shed finger means (19, 98, 113) comprises upper and lower shed fingers (31, 98, 32, 113) mounted for oscillation in a direction transverse to the direction of the seam and adapted for movement to and from respective shed engaging positions.

4. Apparatus as claimed in claim 3, wherein the individual shed fingers (31, 32, 98, 113) are separately mounted for independent movement.

5. Apparatus as claimed in claim 4, wherein the lower shed finger (32, 113) is mounted on an inclined slide (116) for composite translational motion in the direction of the intended seam and perpendicular to the plane of such seam.

6. Apparatus as claimed in claim 3, wherein the upper and lower shed fingers (31, 98, 32, 113) are adapted and arranged, upon operation, for respective engagement with the upper and lower sheets of weft yarns which define the shed.

7. Apparatus as claimed in claim 1, wherein the yarn insertion means (26, 121) includes a needle (28, 123) engageable with the yarn to be inserted and adapted to draw the same into the shed.

8. Apparatus as claimed in claim 7 wherein a respective needle (26, 123) is provided for cooperation with the free warp yarns 28 at each of the opposing ends to be joined.

9. Apparatus as claimed in claim 8, wherein each needle (26, 123) has a yarn-engaging crook-end (27) thereto.

10. Apparatus as claimed in claim 7, wherein each yarn insertion needle (123) is mounted on a radial arm (122) for oscillation in a plane inclined slightly in relation to the plane of the intended seam.

11. Apparatus as claimed in claim 1, wherein each yarn engagement means (25, 125) includes a pin (39, 54) and cooperating abutment member (38, 52) between which a selected yarn (28) is engaged and clamped, such pin and abutment member being movable, on reciprocation of the engagement means (25, 125) between a yarn engagement position remote from the path of movement of the yarn insertion means (26, 121) and a yarn delivery position in such path of movement.

12. Apparatus as claimed in claim 1, further including yarn clamp means (29, 124) at each side of the machine in the path of movement of the yarn insertion means (26, 121) and cooperable with such means to receive a warp yarn (28) from the opposite side of the machine.

13. Apparatus as claimed in claim 1, further including wiper means (99) having a blade (105) selectively engageable with and transversely of the surface of the seam, said wiper means (99) being movable longitudinally of the same to cause the blade to displace protruding warp ends from the region of yarn insertion.

14. Apparatus as claimed in claim 13, wherein said wiper blade (105) is mounted for reciprocation towards and away from the plane of the seam and for translational motion longitudinally thereof.

15. Apparatus as claimed in claim 1 including a micro-processor adapted and arranged to control the operation of the seam forming instrumentalities in timed sequence in relation to the shedding of the weft yarns.

16. Apparatus as claimed in claim 1 wherein the operation of the seam forming instrumentalities is effected by pneumatic means.

* * * * *